United States Patent [19]

Lutz

[11] Patent Number: 4,491,219

[45] Date of Patent: Jan. 1, 1985

[54] CONTAINER FOR TWO-COMPONENT SYSTEMS

[75] Inventor: Hans Lutz, Stuttgart, Fed. Rep. of Germany

[73] Assignee: Lechler Chemie GmbH, Stuttgart, Fed. Rep. of Germany

[21] Appl. No.: 357,165

[22] Filed: Mar. 11, 1982

[30] Foreign Application Priority Data

Mar. 25, 1981 [DE] Fed. Rep. of Germany ..... 3111733
Jan. 15, 1982 [DE] Fed. Rep. of Germany ..... 3201035

[51] Int. Cl.[3] ..... B65D 21/02

[52] U.S. Cl. ..... 206/216; 220/20; 220/23.86; 220/70; 220/296; 220/413

[58] Field of Search ..... 206/216, 218, 219, 525; 220/408, 93, 410, 413, 23, 219, 85 B, 23.83, 276, 287, 23.86, 265, 70, 255, 68, 233, 235, 207, 254, 266, 8, 256, 296, 352; 137/203; 251/144; 426/113, 115, 120; 217/110, 111, 104; 222/510, 545, 546; 215/250-257, 32

[56] References Cited

U.S. PATENT DOCUMENTS

| | | | |
|---|---|---|---|
| 307,192 | 10/1884 | Halstead | 220/410 |
| 342,397 | 5/1886 | Smith | 220/408 |
| 524,900 | 8/1894 | James | 222/510 |
| 897,729 | 9/1908 | Foreman | 222/510 |
| 985,106 | 2/1911 | Bradshaw | 220/8 |
| 1,383,972 | 7/1921 | Biette | 220/408 |
| 1,507,098 | 9/1924 | Walker | 251/144 |
| 1,765,062 | 6/1930 | Draper | 220/254 |
| 1,832,669 | 11/1931 | Thomas | 220/256 |
| 2,110,411 | 3/1938 | White | 220/20 |
| 2,237,293 | 4/1941 | Dukehart, Jr. | 220/23 |
| 2,287,610 | 6/1942 | Guidry | 426/120 |
| 2,391,337 | 12/1945 | O'Neil | 220/266 |
| 3,018,970 | 1/1962 | Wittenberg et al. | 220/20 |
| 3,070,275 | 12/1962 | Bostrom | 220/408 |
| 3,590,989 | 7/1971 | Wittner | 220/20 X |
| 3,944,074 | 3/1976 | Riley | 220/23.4 |
| 4,018,904 | 4/1977 | Muraoka | 220/276 |
| 4,098,404 | 7/1978 | Markert | 206/525 |
| 4,120,419 | 10/1978 | Saunders | 220/66 |
| 4,204,597 | 5/1980 | Fischer | 206/216 |
| 4,348,421 | 9/1982 | Sakakibara et al. | 220/408 X |

FOREIGN PATENT DOCUMENTS

| | | | |
|---|---|---|---|
| 7124841 | 6/1971 | Fed. Rep. of Germany . | |
| 2750887 | 5/1979 | Fed. Rep. of Germany . | |
| 447679 | 1/1913 | France | 220/8 |
| 1559439 | 1/1980 | United Kingdom . | |

*Primary Examiner*—Allan N. Shoap
*Assistant Examiner*—Bryon Gehman
*Attorney, Agent, or Firm*—Curtis, Morris & Safford

[57] ABSTRACT

What is disclosed is a container adaptable to the common, but separate, storage of two materials, said container comprising a first outer container for accommodation of a first material, said outer container being closable by a cover and having a peripheral external bead, and a second inner container, removably disposed within said outer container, for accommodation of a second material, said inner container having at least one peripheral retaining element projecting outwardly therefrom, which element engages said peripheral external bead of said outer container when said inner container is completely disposed within said outer container.

19 Claims, 7 Drawing Figures

FIG. 1
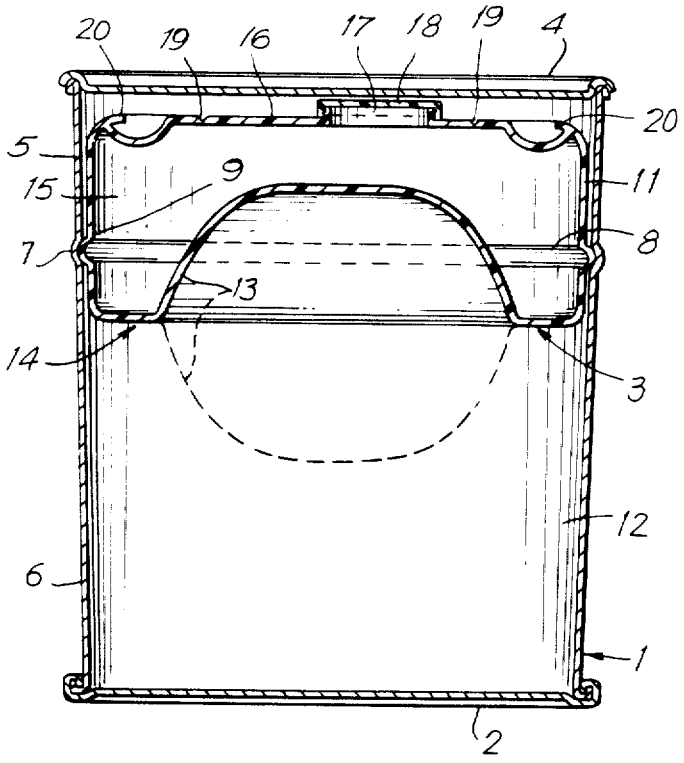
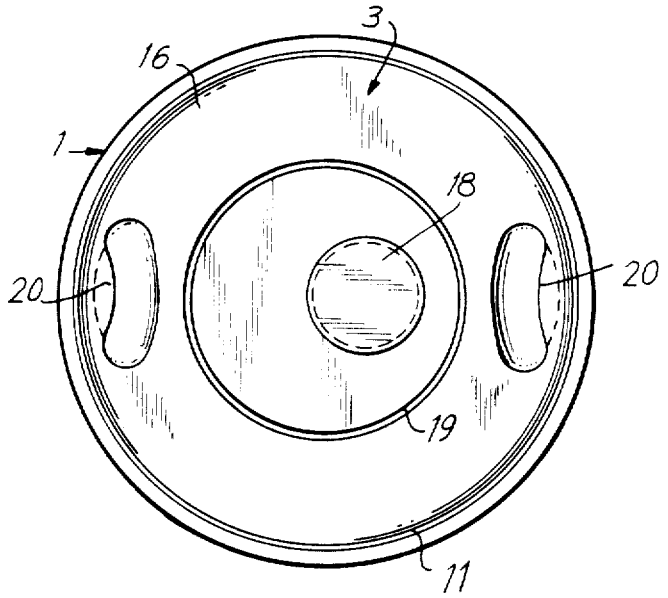
FIG. 2

CONTAINER FOR TWO-COMPONENT SYSTEMS

The present invention relates to a container adaptable to the common storage of two materials which are separated within the container, e.g. two different components of a two-component chemical system.

A container of this type is known from German published unexamined patent application No. DE-AS 27 50 887 and comprises an outer container having an upper external bead on its periphery and an inner container, open at the top, suspended by an externally beaded rim from the external bead of the outer container. The container comprises a cover which is common to both the inner and outer container and which is secured around the upper external bead of the outer container by a beaded retaining ring. The disadvantages of this structure are that it is difficult to remove the inner container from the outer container after opening and that neither of these containers can be tightly reclosed with the cover, but can at best only be loosely covered therewith. Further, the intricately structured closure area is complicated and expensive to produce.

The object of the present invention is to provide such a container for the common storage of two materials which has a simpler and more serviceable closure area and to improve the serviceability and handling of the inner container.

An understanding of the present invention and of how the features thereof achieve this object will be had by referring to the accompanying drawings, wherein FIG. 1 is a side view, in section, through a first embodiment of the container;

FIG. 2 is a plan view of the container of FIG. 1 with its cover removed;

Figure 3A:
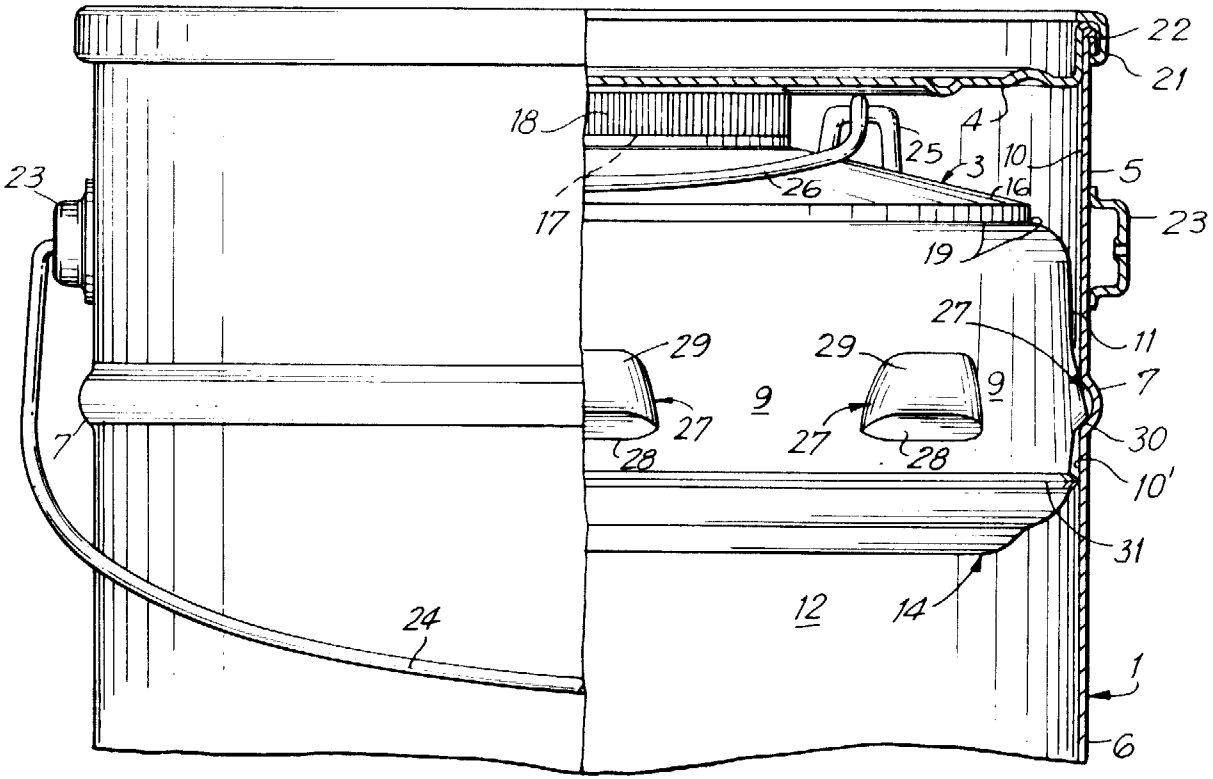
FIGS. 3A and 3B are side views, partially in section, through a second embodiment of the container, FIG. 3B being the lower continuation of FIG. 3A.

As shown in FIGS. 1 and 2, outer container 1, suitably constructed from a material such as tinplate and having rabbeted bottom 2, has inserted therein smaller inner container 3, suitably made of a material such as plastic. The upper end of outer container 1 can be closed with cover 4 which may be constructed in any desired appropriate manner, for example as a snap-in cover. Outer container 1 has upper cylindrical body section 5 and lower body section 6 which tapers downwardly conically. Body sections 5 and 6 are separated from each other by outwardly projecting peripheral bead 7 constructed as a stacking bead. Peripheral retaining element 8, which projects outwardly from inner container 3, resiliently engages bead 7. Inner container 3 is thus secured against rotation, and especially against axial motion, relative to outer container 1. Retaining element 8 essentially possesses shape retention and is fastened to radially resilient wall portion 9 of inner container 3. As inner container 3 is inserted into outer container 1, retaining element 8 comes into contact with internal surface 10 of outer container 1 and is resiliently forced radially inward by it. As inner container 3 is pushed farther in, retaining element 8, radially pretensioned, slides farther down along internal surface 10 until retaining element 8 snaps into bead 7 to lock inner container 3 relative to outer container 1. When inner container 3 is pulled out of outer container 1, these events occur in reverse order.

Except for retaining element 8, external surface 11 of inner container 3 is spaced in its entirety from internal surface 10 of outer container 1. In the inserted position shown in FIG. 1, retaining element 8 further acts as a seal with respect to internal surface 10 of outer container 1 so that a first component substantially contained in interior space 12 of outer container 1 cannot rise past retaining element 8 and flood the upper part of inner container 3.

Bottom 14 of inner container 3 comprises center portion 13 which is adapted to move up or down in the manner of a diaphragm. In FIG. 1, center portion 13 is shown in solid lines in an upper extreme position in which it bulges into interior space 15 of inner container 3 and in dashed lines in a lower extreme position in which it bulges into interior space 12 of outer container 1. In this way, the amount of a second component contained in inner container 3 can be varied in relation to the amount of the first component in outer container 1 without it being necessary to make a structural change in inner or outer containers.

Inner container 3 comprises relatively small opening 17, located off center, in upper wall 16 thereof, which opening can be opened and reclosed by means of a closure, for instance in the form of screw cap 18. Outside opening 17, upper wall 16 is provided with guide groove 19 along which upper wall 16 can be cut open and its middle portion removed to create a large discharge opening in inner container 3. Diametrically opposed handgrips 20 having gripping recesses which facilitate the handling of inner container 3 are suitably provided in upper wall 16, for example by molding.

Figure 3B:
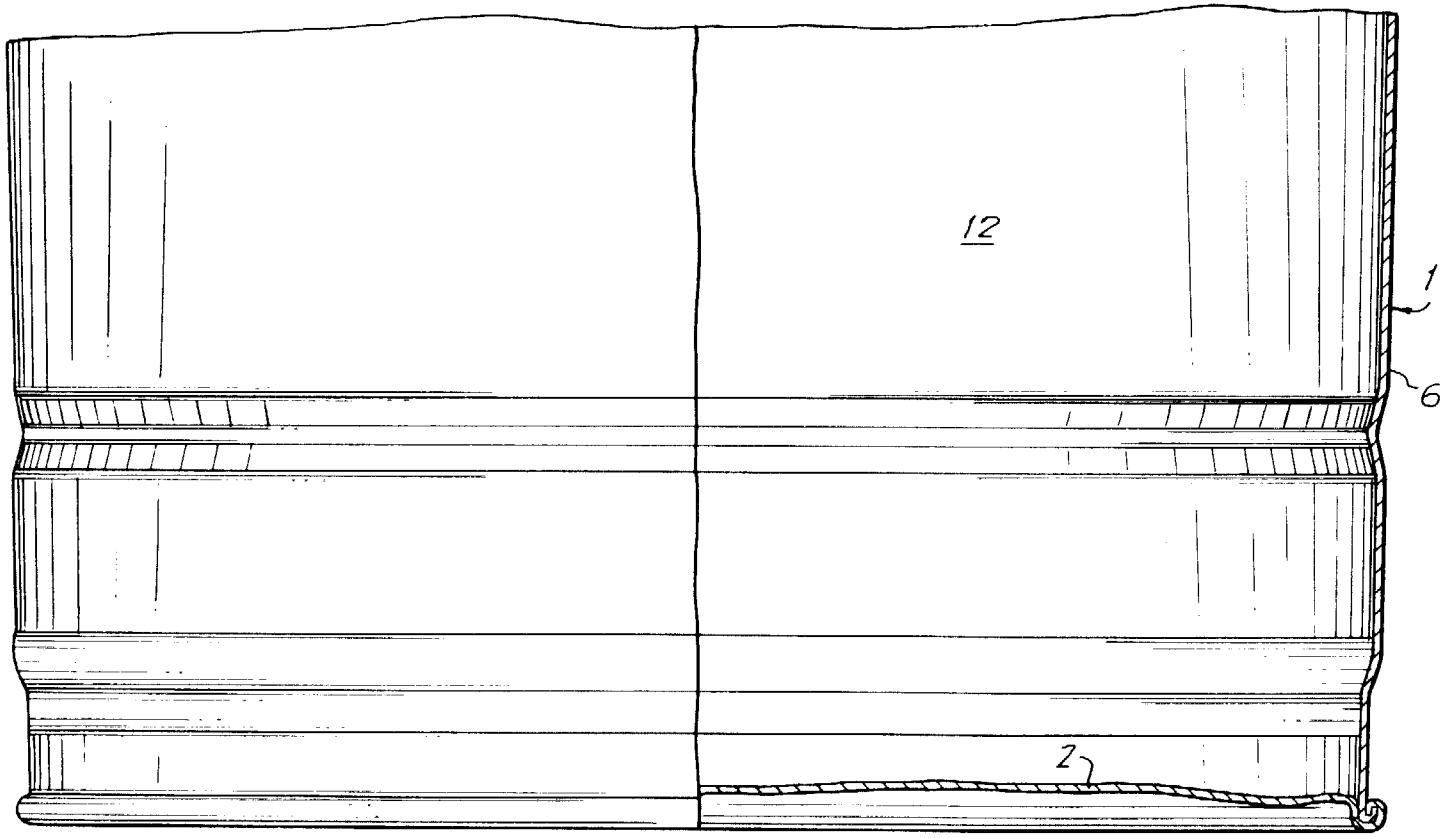
Figure 4:
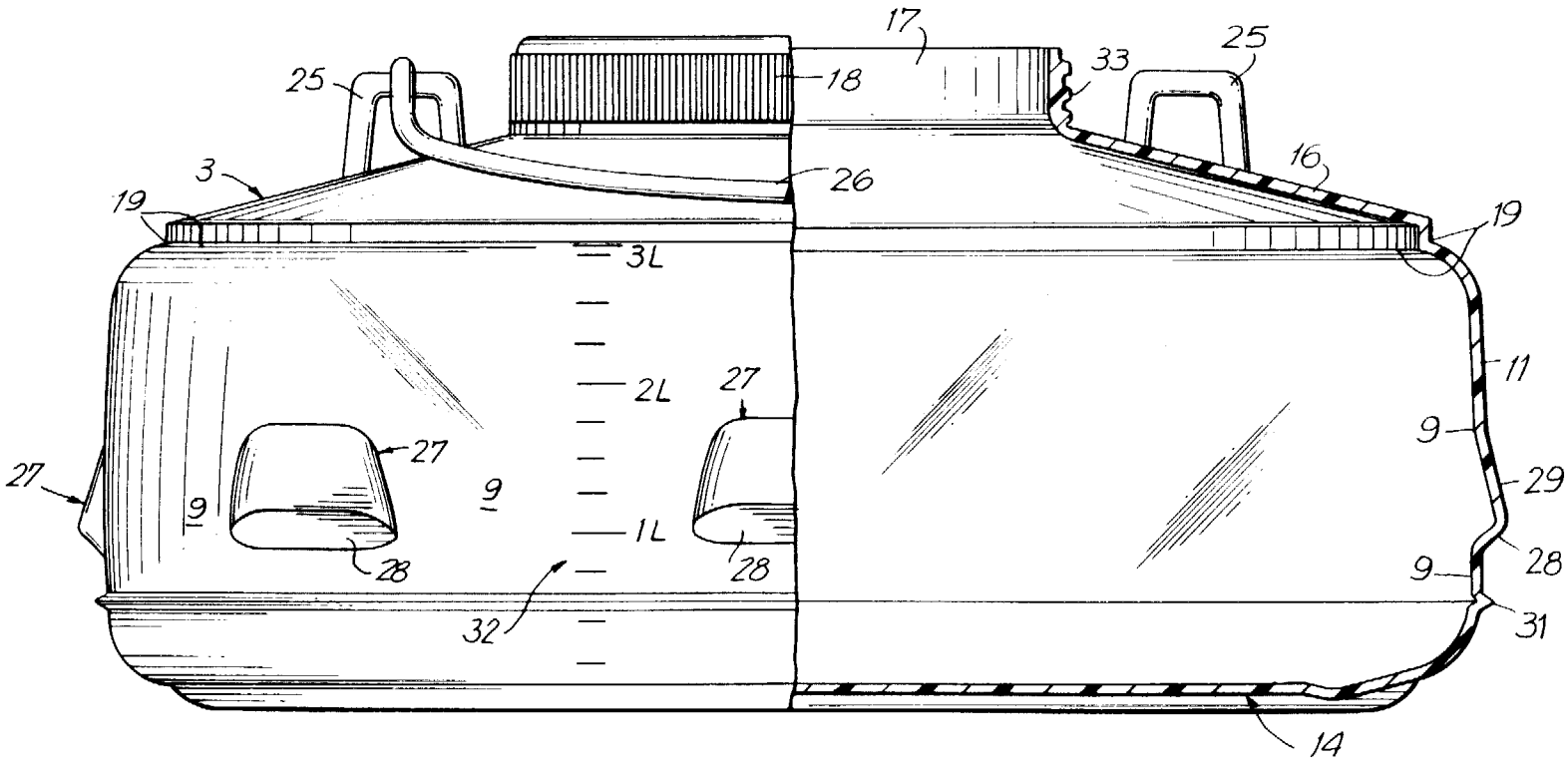
FIG. 4 is a side view, partially in section, through the inner container of FIG. 3A.

In the further different embodiment shown in FIGS. 3A, 3B and 4, parts identical with those of FIGS. 1 and 2 are designated by the same reference numerals.

FIG. 3A shows cover 4 secured to outer container 1 by means of peripheral retaining strip 21 which is flanged under external bead 22 of outer container 1. Diametrically opposed lugs 23 for bail handle 24 are disposed on upper cylindrical section 5 of container 1.

Upper wall 16 of inner container 3 is likewise suitably provided with lugs 25 for handle 26. The latter is used in pulling inner container 3 out of outer container 1 and also in carrying the removed inner container.

As is especially apparent from FIG. 4, upper wall 16 of inner container 3 is inclined toward opening 17 in the manner of an inverted funnel to facilitate the emptying of said container.

As shown in FIGS. 3A and 4, a plurlaity of spaced retaining elements 27 is distributed over the periphery of inner container 3. Retaining elements 27 are essentially shape-retaining and are molded onto radially resilient wall portion 9 of inner container 3. Each retaining element 27 comprises lower detent surface 28 and upper release surface 29. Detent surface 28 makes a smaller angle with the horizontal than does release surface 29. As may be seen from FIG. 3A, region 30 of an internal surface of bead 7 which comes in contact with detent surface 28 is inclined to the horizontal in a manner complementary to detent surface 28. In this way, a secure seat having a defined area of contact with outer container 1 is provided for inner container 3 when it is in its inserted position. At the same time, withdrawal of inner container 3 from outer container 1 is facilitated by relatively steeply inclined release surfaces 29 without reducing the effectiveness of the axial fixing of inner container 3 relative to outer container 1.

In proximity to its bottom 14, inner container 3 is provided with peripheral sealing ridge 31 which, when inner container 3 is inserted in container 1, resiliently bears on sealing area 10' of internal surface 10 of outer container 1 and prevents flooding of the upper part of inner container 3 by the first component contained in outer container 1. Since sealing area 10' is part of conically downwardly, tapering body section 6, sealing ridge 31 makes sealing contact with internal surface 10 only at a relatively late stage during the insertion of inner container 3 in outer container 1 and until then permits any air compressed in interior space 12 to flow past it. With the exception of retaining elements 27 and sealing ridge 31, external surface 11 of inner container 3 is spaced from internal surface 10 of outer container 1, and desirable seating and friction conditions are thus created for the sealing function of sealing ridge 31 and for the handling of inner container 3 generally in relation to outer container 1.

As shown in FIG. 4, when inner container 3 is made of a transparent material, such as a plastic, it may be provided with scale 32 which will permit the amount of the second component still contained in the inner container 3 to be estimated from outside. As is further apparent from FIG. 4, inner container 3 can be provided in proximity to opening 17 (which in this case is centrally located) with external thread 33 which is engaged by a complementary internal thread (not shown) of closure 18 in the form of a screw cap.

Figure 5:
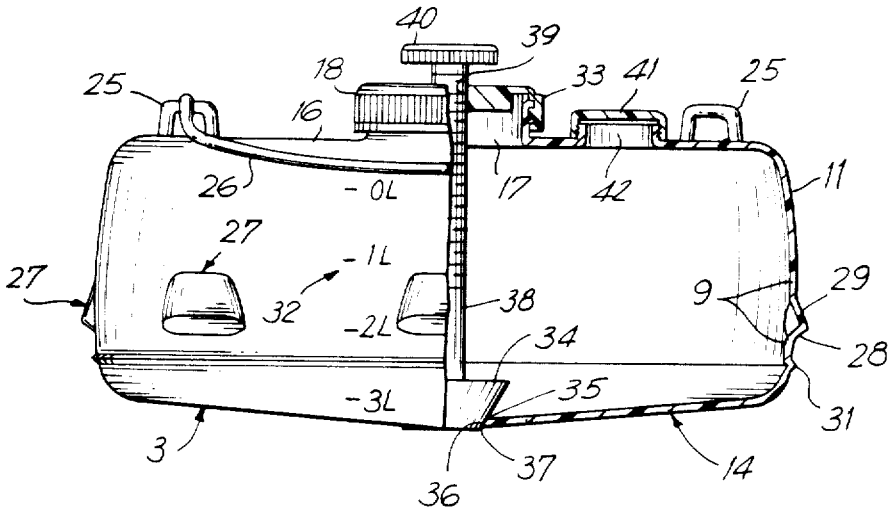
FIG. 5 is a side view, partially in section, through another embodiment of an inner container having a bottom closure.
Figure 6:
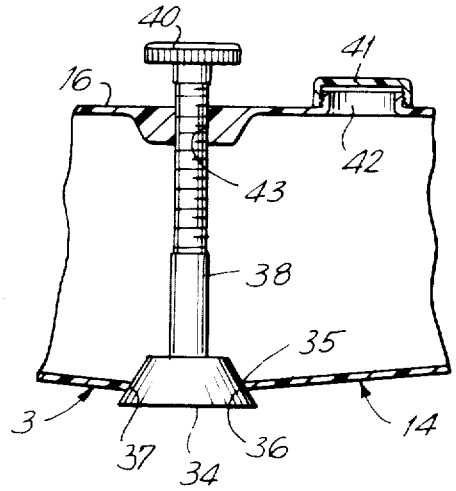
FIG. 6 is a side view, in section, through a portion of a still further embodiment of an inner container with a different bottom closure.

In FIGS. 5 and 6, showing two further embodiments of inner container 3, identical parts are again designated by the same reference numerals as in the preceding Figures.

As shown in FIG. 5, frustoconical valve plug 34 comprising sealing surface 35 is pressed from the interior of inner container 3 against complementary seating surface 36 which bounds opening 37 in bottom 14 of inner container 3. Threaded rod 38, which is attached to valve plug 34, extends upwardly through threaded bore 39 in closure 18. After the insertion of rod 38, knob 40 for actuation of threaded rod 38 is fastened to the upper, free end of rod 38.

Material such as the second component of a two-component chemical system is preferably introduced into inner container 3 through filler neck 42 adapted to be closed with a closure such as screw cap 41. If there is no such filler neck 42, valve plug 34 is screwed back and bottom opening 37 is used for filling after the inner container has been turned upside down. In that filling position, valve plug 34 is then screwed against seating surface 36 until plug 34 is tightly seated. Inner container 3 can then be placed into its normal upright position and inserted in outer container 1.

All that need to be done to withdraw its contents from inner container 3 is to raise valve plug 34 from its sealed position, shown in FIG. 5, by turning knob 40 until bottom opening 37 has been sufficiently opened. When the inner container is made of a transparent material, the discharge of its contents from inner container 3 can readily be monitored by means of scale 32.

According to FIG. 6, threaded rod 38 passes directly through threaded bore 43 in upper wall 16 of inner container 3. In this case, too, knob 40 has been fastened to the upper, free end of threaded rod 38. In this embodiment, bottom opening 37 of inner container 3 is closed by drawing valve plug 34, by means of threaded rod 38, against seating surface 36 from outside inner container 3.

In both FIG. 5 and in FIG. 6, bottom 14 is inclined downwardly toward seating surface 36 in the manner of a funnel.

To permit outer container 1 to be stacked, it is constructed so that it tapers downwardly conically, at least below bead 7. Inner container 3 is preferably blow-molded from a plastic material that is resistant to the material with which a given container is to be filled. This is a relatively lowcost production method which nevertheless assures high dimensional accuracy of the inner container. A suitable material is low-pressure polyethylene, for example. The inner container may hold a curing agent, for example, and the remaining interior of the outer container the coating solution with which it is to be used.

Since inner container 3 is disposed completely in the interior of outer container 1, the closure area between the outer container and cover 4, is not subjected to stresses and is completely separated from the inner container. This means that any suitable commercially available cover and any appropriate rim design for the outer container may be selected without their compatibility with a connecting member for the inner container having to be taken into consideration. But even though the inner container is in no way connected to the closure area, the inner container is adequately fixed with respect to the outer container by at least one retaining element. The retaining elements, in conjunction with the bead on the outer container, form a kind of resilient snap-fit closure which can readily be dimensioned and designed to prevent undesired motion of the inner container relative to the outer container.

A retaining element such as 8 of FIG. 1 may further serve as a seal that prevents the contents of outer container 1 from getting onto the top of the inner container, which would be undesirable.

Spaced retaining elements 27 permit a particularly precise selection of the yielding retaining force. Moreover, gas flow is possible between adjacent retaining elements as the inner container is pushed into or pulled out of the container, such gas flow facilitating motion of the inner container relative to the outer container.

Making the retaining elements such as 8 and 27 integral with the inner container permits the retaining elements to be produced particularly simply and cheaply.

Construction of the retaining elements to be shape-retaining and fastened to a radially resilient wall portion of the inner container assures secure seating of the elements in bead 8 of the outer container.

Detent surface 28 of retaining elements 27 serves the same purpose, while release surface 29 facilitates radial yielding of the retaining elements as the inner container is pulled out.

The angular disposition of the detent and release surfaces provides for particularly favorable operating conditions with respect to the retaining elements, and the complementary matching of portions 30 of bead 7 with detent surface 28 provides for a relatively large contact area between the detent surface and the bead, which enhances the tension.

By spacing the external surface of the inner container from the interior surface of the outer container, sliding friction between the inner container and the outer container is reduced to a minimum during insertion or withdrawal of the inner container, which simplifies handling.

Peripheral sealing ridge 31 prevents flooding of the inner container by material present in the outer container if the container tips over, for example, or if it is severely shaken during transportation. The yielding contact pressure with which the sealing ridge bears on the outer container need merely be sufficient to assure that the sealing ridge bears on the outer container all around once the inner container has been inserted. Because of the sealing ridge, only the bottom part of the inner container below the sealing ridge can be wetted by the first component. After the inner container has been lifted out of the outer container, that bottom part can be brushed against the upper rim of the outer container and thus rough-cleaned. The cover of the outer container can then serve as a base on which to place the inner container so rough-cleaned.

By making the outer container of larger diameter in surface region 10 above sealing region 10' than its diameter in this sealing region, the circulation of air between sealing ridge 31 and the internal surface of the outer container is permitted, so long as the sealing ridge is not in contact with the sealing region. Handling of the inner container is thus facilitated.

By fashioning bottom 14 of inner container 3 to have a moveable diaphagm portion 13, the container can be adapted by simple means to different relative amounts of the components present in the inner and outer containers. There is no need to stock inner containers of a capacity corresponding exactly to each such quantity ratio.

The inner container, which is preferably closable independently of the outer container, can be sealed with a sealing foil, for example, or closed with a screw cap. In the latter case, the opening can then be tightly reclosed. When the container holds a liquid, the opening serves as a filling and pouring opening. A large discharge opening can be created by cutting the inner container open along guide groove 19 in the case of viscous and not readily pourable materials. Through that larger discharge opening, such a material can then be scraped out of the inner container using a spatula, for example.

The valve plug arrangement of the embodiments shows in FIGS. 5 and 6 facilitates handling and permits particularly clean working. Bottom opening 37 is reclosable so that only part of its contents can be withdrawn from the inner container. The inner container then need not be tilted to withdraw material through the bottom opening. In an upper wall of the inner container, a separate filler neck may be provided for the second component if the latter is not to be introduced through the bottom opening.

The threaded rod arrangement permits the valve plug to be actuated in a particularly simple and dependable manner. The threaded rod and valve plug may be made of the same material as the rest of the inner container, e.g. of plastic.

Passing the rod through a threaded bore in the upper wall of containe 3, as shown in FIG. 6 permits the threaded rod to be supported in the inner container in a particularly simple manner. The valve plug is then drawn against the valve seat from outside the inner container. The structure shown in FIG. 5, on the other hand, makes it possible to press valve plug against the valve seat from the interior of the inner container. The inside diameter of opening 17 in upper wall 16 is then such that the valve plug will pass through it.

Tapering bottom 14 of the inner container downwardly, as shown in the embodiments of FIGS. 5 and 6, facilitates both runoff of the contents of the container from the underside of the bottom of the inner container and outflow of the contents of the inner container along the inner surface of its bottom.

What is claimed is:

1. A container adaptable to the common, but separate, storage and shipment of two different chemical materials, said container comprising a first bucket shaped outer container having a bottom, an open top and being formed of metal for accommodation of a first material, and a cover for closing said open top of the outer container, said outer container having a side wall including a peripheral outwardly extending external bead spaced from said cover and defining an internal circumferential cavity in said side wall, and a second inner container, removably disposed within said outer container, for accommodation of a second material, said inner container being formed of a plastic material and having top and bottom walls and means on said inner container for holding said inner container in the outer container and for forming a seal therebetween including at least one peripheral retaining means projecting outwardly therefrom between said top and bottom walls for resilient engagement in said circumferential cavity defined by said peripheral external bead of said outer container when said inner container is completely disposed within an upper part of said outer container said retaining means cooperating with said peripheral external bead to define the primary support for the inner container in the outer container, resist inward movement of said inner container beyond a position at which said retaining means is engaged with the bead in the cavity and resiliently but releasably resisting upward movement of said inner container toward said open top from said position, said bead and retaining means being located such that when said retaining means engages said bead the top wall of the inner container is spaced from and located below the cover of the outer container, said top wall of said inner container having holding means thereof for use in removing and inserting said inner container in the outer container and a closable aperture therein; said inner container having an external peripheral configuration in plan which is generally complementary to the internal peripheral configuration in plan of the outer container; said bottom wall of the inner container and the bottom wall of the outer container being spaced from one another when said retaining means is engaged in said bead to define a chamber in the outer container for holding a different material from material in the inner container whereby material in said chamber is prevented from moving upwardly in the outer container around the inner container by said means for sealing.

2. A container as in claim 1 wherein said retaining means is a single peripheral retaining element formed integrally with said inner container.

3. A container as in claim 1 wherein said retaining means comprises a plurality of circumferentially spaced peripheral retaining elements.

4. A container as in claim 1 wherein said retaining means comprises at least one peripheral retaining element which is substantially shape-retaining and is fastened to a radially resilient side wall portion of said inner container.

5. A container as in claim 1 wherein said at least one peripheral retaining means includes a lower detent surface and an upper release surface.

6. A container as in claim 5 wherein said detent surface is at a smaller angle to the horizontal than is said release surface.

7. A container as in claim 6 wherein an inner surface of said peripheral external bead on said outer container comprises a region inclined to the horizontal at an angle complementary to the angle to the horizontal of said detent surface, said region and said detent surface being in contact when the retaining element of said inner container and the peripheral external bead of said outer container are engaged.

8. A container as in claim 1 wherein the periphery of said inner container is spaced slightly inwardly from the inner surface of said outer container along its entire height except for the engagement of said retaining element with said peripheral external bead.

9. A container as in claim 1 wherein said means for holding and forming a seal includes a peripheral outer sealing ridge on said inner container and said outer container has an inner sealing region, which ridge and sealing region are in resilient contact when said inner container is completely disposed in said outer container.

10. A container as in claim 9 wherein said outer container is of greater diameter above said sealing region than in said sealing region.

11. A container as in claim 9 wherein said inner container is spaced from said outer container except for the engagement of said retaining element with said peripheral external bead and for the resilient contact between said ridge and said sealing region.

12. A container as in claim 1 wherein said bottom wall of the inner container includes a flexible diaphragm portion capable of upward and downward flexion.

13. A container as in claim 1 wherein said top wall of said inner container slopes downwardly from said closable aperture when said inner container is in an upright position.

14. A container as in claim 1 wherein said top wall is scored around said closable aperture to form a weakened wall portion in the form of a guide groove.

15. A container as in claim 1 wherein said bottom wall of said inner container has an aperture therein surrounded by a seating surface, and further comprising a moveable valve plug having a sealing surface, said seating surface and sealing surface cooperating to seal the bottom of said inner container when said moveable valve plug is in a closed position.

16. A container as in claim 15 wherein said moveable valve plug is disposed on a threaded rod supported by said top wall of said inner container.

17. A container as in claim 16 wherein said top wall has a threaded bore therein and said threaded rod passes through said threaded bore.

18. A container as in claim 16 wherein said top wall has a closable aperture therein and a closure for said aperture, said closure having a threaded bore therein, and wherein said threaded rod passes through said threaded bore.

19. A container as in claim 15 wherein said bottom wall of said inner container slopes downwardly toward said aperture therein when said inner container is in an upright position.

* * * * *